US009916806B2

(12) United States Patent
Cho et al.

(10) Patent No.: US 9,916,806 B2
(45) Date of Patent: Mar. 13, 2018

(54) LIQUID CRYSTAL DISPLAY APPARATUS AND DRIVING METHOD THEREOF

(71) Applicant: SAMSUNG DISPLAY CO., LTD., Yongin, Gyeonggi-do (KR)

(72) Inventors: Hyun Min Cho, Seoul (KR); Jae Byung Park, Seoul (KR); Seon-Tae Yoon, Seoul (KR); Kwangkeun Lee, Gyeonggi-do (KR); Jaehyun Cho, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 526 days.

(21) Appl. No.: 14/471,665

(22) Filed: Aug. 28, 2014

(65) Prior Publication Data

US 2015/0194117 A1 Jul. 9, 2015

(30) Foreign Application Priority Data

Jan. 3, 2014 (KR) ..... 10-2014-0000882

(51) Int. Cl.
*G09G 3/36* (2006.01)
*G09G 3/34* (2006.01)

(52) U.S. Cl.
CPC ..... *G09G 3/3685* (2013.01); *G09G 3/3413* (2013.01); *G09G 3/3607* (2013.01); *G09G 3/3611* (2013.01); *G09G 2320/064* (2013.01); *G09G 2340/06* (2013.01)

(58) Field of Classification Search
None
See application file for complete search history.

(56) References Cited

U.S. PATENT DOCUMENTS

2006/0238551 A1* 10/2006 Dalal ..... G09G 3/002 345/690
2011/0148908 A1* 6/2011 Jeong ..... G09G 5/02 345/590
2013/0300771 A1 11/2013 Cho et al.
2014/0152724 A1 6/2014 Park et al.

FOREIGN PATENT DOCUMENTS

KR 1020050095443 9/2005
KR 1020120127211 11/2012
KR 1020150033437 4/2015
KR 1020150047402 5/2015

* cited by examiner

*Primary Examiner* — Jennifer Mehmood
*Assistant Examiner* — Parul Gupta
(74) *Attorney, Agent, or Firm* — F. Chau & Associates, LLC

(57) ABSTRACT

A liquid crystal display apparatus includes a gamma mapping unit configured to receive red, green, and blue image information from an external device. During the first field, the gamma mapping unit generates first to third data signals for controlling the first to third pixels based on the red, green, and blue image information in synchronization with the backlight unit. During the second field, the gamma mapping unit generates fourth and fifth data signals for controlling the first and second pixels based on at least one of the first to third data signals or based on the red, green, and blue image information. As the quantity of the second color light leaked is adjusted through the first and second color filters in the second field, a color reproduction range and brightness of the liquid crystal display panel are improved. Thus, the display quality of the liquid crystal display apparatus is improved.

4 Claims, 9 Drawing Sheets

<First field(FD1)>

<Second field(FD2)>

LIQUID CRYSTAL DISPLAY APPARATUS AND DRIVING METHOD THEREOF

CROSS-REFERENCE TO RELATED APPLICATION

This application claims priority under 35 U.S.C. § 119 to Korean Patent Application No. 10-2014-0000882, filed on Jan. 3, 2014 in the Korean Intellectual Property Office, the disclosure of which is incorporated by reference herein in its entirety.

TECHNICAL FIELD

The present invention relates to a liquid crystal display apparatus and a driving method thereof.

DISCUSSION OF RELATED ART

Liquid crystal display apparatuses express a full color image using a space division manner or a field sequential manner. For a space division manner, red, green, and blue color filters are arranged on corresponding subpixels to display a full color image. For a field sequential manner, red, green, and blue light sources emitting red, green, and blue color light are arranged at the back of a liquid crystal display panel, without using color filters, to express a full color image. Such light sources are sequentially provided to pixels.

SUMMARY

According to an exemplary embodiment of the present invention, a liquid crystal display apparatus includes a backlight unit, a liquid crystal display panel and a gamma mapping unit. The backlight unit sequentially provides first color light during a first subframe time of a frame and second color light during a second subframe time of the frame. The first color light includes at least two primary colors. The liquid crystal display panel includes a pixel, and first and second color filters. The pixel is formed of first, second and third subpixels. One of the at least two primary colors is transmitted to the first subpixel through the first color filter. Another of the at least two primary colors is transmitted to the second subpixel through the second color filter. The second color light is transmitted to the third subpixel without using any color filter. The gamma mapping unit receives red, green and blue image information from an external device, generates first to third data signals based on the red, green and blue image information for driving the first to third subpixels for the first subpixel time, and generates fourth to sixth data signals for driving the first to third subpixels for the second subpixel time.

A method of driving a liquid crystal display apparatus according to an exemplary embodiment of the present invention is provided. Red, green, and blue image information are received to drive a pixel during a frame. The frame is formed of a first subframe time and a second subframe time. First and second color light are provided during the first and second subframe time, respectively. First to third data signals and fourth to sixth data signals are generated based on the red, green and blue image information. The first to third data signals are provided to the pixel during the first subframe time and the fourth and sixth data signals are provided to the pixel during the second subframe time. The first and second data signals are provided to a first subpixel of the pixel, the second and fifth data signals are provided to a second subpixel of the pixel, and the third and sixth data signals are provided to a third subpixel of the pixel.

BRIEF DESCRIPTION OF THE DRAWINGS

These and other features of the present invention will become more apparent by describing in detail exemplary embodiments thereof with reference to the accompanying drawings of which.

DETAILED DESCRIPTION OF EXEMPLARY EMBODIMENTS

Figure 1:
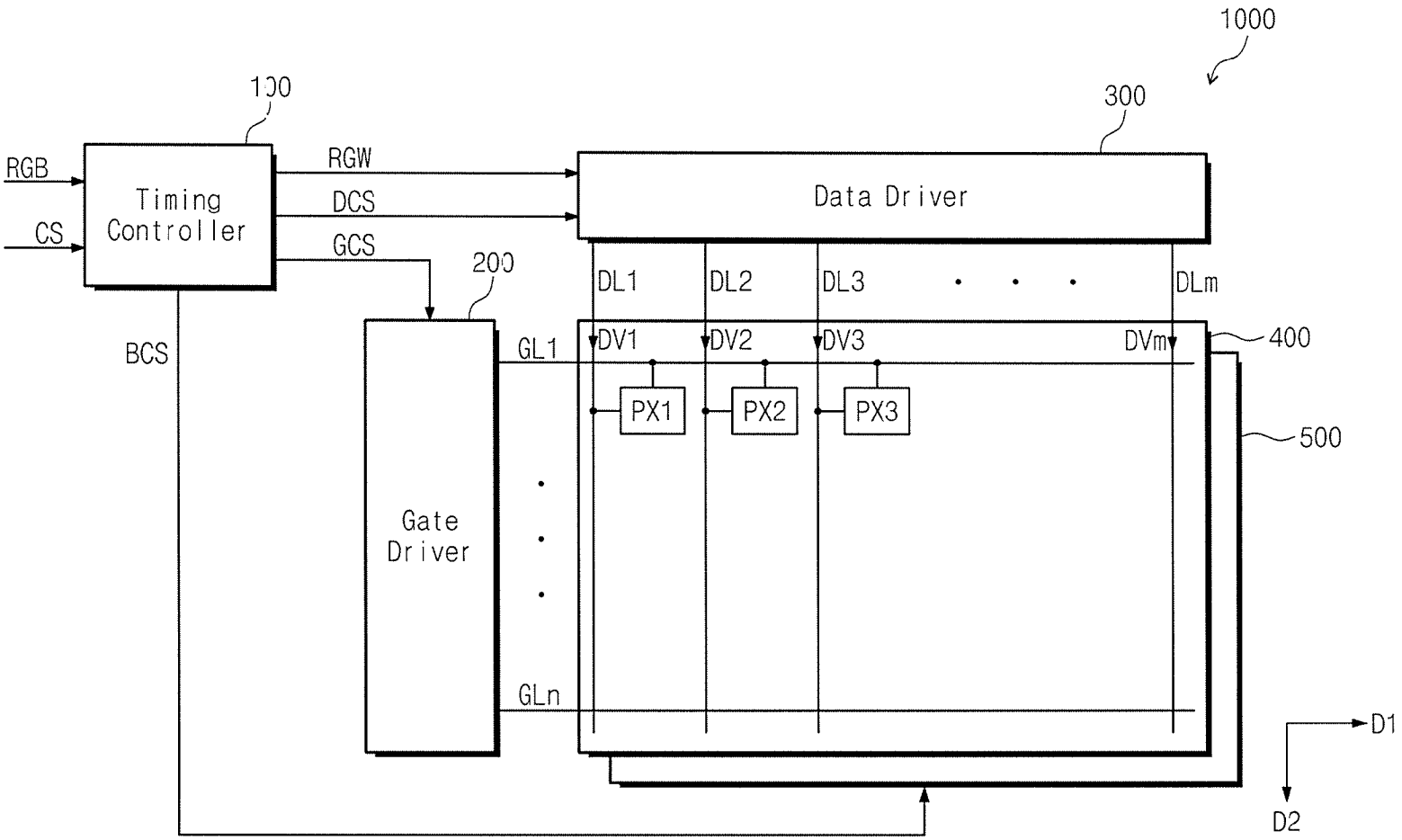
FIG. 1 is a block diagram illustrating a liquid crystal display apparatus according to an exemplary embodiment of the present invention.

Exemplary embodiments of the present invention will be described below in detail with reference to the accompanying drawings. However, the present invention may be embodied in different forms and should not be construed as limited to the embodiments set forth herein. In the drawings, the thickness of layers and regions may be exaggerated for clarity. It will also be understood that when an element is referred to as being "on" another element or substrate, it may be directly on the other element or substrate, or intervening layers may also be present. It will also be understood that when an element is referred to as being "coupled to" or "connected to" another element, it may be directly coupled to or connected to the other element, or intervening elements may also be present. Like reference numerals may refer to the like elements throughout the specification and drawings.

FIG. 1 is a block diagram illustrating a liquid crystal display apparatus according to an exemplary embodiment of the present invention.

Referring to FIG. 1, a liquid crystal display apparatus 1000 according to an exemplary embodiment of the present invention includes a liquid crystal display panel 400 to display an image, a gate driver 200 and a data driver 300 to drive the liquid crystal display panel 400, and a timing controller 100 to control the gate driver 200 and the data driver 300.

The timing controller 100 receives image information RGB and control signals CS from the outside of the liquid crystal display apparatus 1000. The timing controller 100 converts a data format of the image information RGB to be suitable for the interface specifications of the data driver 300 and generates image data RGW as the conversion result. The image data RGW is provided to the data driver 300. The timing controller 100 generates a data control signal DCS (e.g., including an output start signal, a horizontal start signal, and the like) and a gate control signal GCS (e.g., including a vertical start signal, a vertical clock signal, and a vertical clock bar signal) based on the control signals CS. The data control signal DCS is provided to the data driver 300, and the gate control signal GCS is provided to the gate driver 200.

The gate driver 200 sequentially outputs gate signals in response to the gate control signal GCS from the timing controller 100; hence, pixels are sequentially scanned by the gate signals by a row unit.

The data driver 300 converts the image data RGW into data voltages in response to the data control signal DCS from the timing controller 100. The data voltages thus converted include data voltages DV1 to DVm that are provided to the liquid crystal display panel 400.

The liquid crystal display panel 400 includes gate lines GL1 to GLn, data lines DL1 to DLm, and pixels.

The gate lines GL1 to GLn are extended in a first direction D1 and are arranged in parallel with one another in a second direction D2 substantially perpendicular to the first direction D1. The gate lines GL1 to GLn are connected to the gate driver 200 and receive the gate signals from the gate driver 200.

The data lines DL1 to DLm are extended in the second direction D2 and are arranged in parallel with one another in the first direction D1. The data lines DL1 to DLm are connected to the data driver 300 and receive the data voltages from the data driver 300.

The pixels include first to third pixels PX1 to PX3 that display different colors. The first to third pixels PX1 to PX3 are spaced apart from one another along the first direction D1. Each of the first to third pixels PX1 to PX3 may include a thin film transistor and a liquid crystal capacitor.

Each of the first to third pixels PX1 to PX3 may be connected to a corresponding one of the gate lines GL1 to GLn and to a corresponding one of the data lines DL1 to DLm. Each of the first to third pixels PX1 to PX3 may be driven independently from each other.

For example, the first pixel PX1 is connected to the first gate line GL1 and the first data line DL1 and receives a corresponding gate signal and a first data voltage DV1. When turned on by the corresponding gate signal, the first pixel PX1 displays an image with a gray scale corresponding to the first data voltage DV1.

The second pixel PX2 is connected to the second gate line GL2 and the second data line DL2 and receives a corresponding gate signal and a second data voltage DV2. When turned on by the corresponding gate signal, the second pixel PX2 displays an image with a gray scale corresponding to the second data voltage DV2.

The third pixel PX3 is connected to the third gate line GL3 and the third data line DL3 and receives a corresponding gate signal and a third data voltage DV3. When turned on by the corresponding gate signal, the third pixel PX3 displays an image with a gray scale corresponding to the third data voltage DV3.

As illustrated in FIG. 1, the liquid crystal display apparatus 1000 according to an exemplary embodiment of the present invention further comprises a backlight unit 500 that is placed on the back side of the liquid crystal display panel 400. The timing controller 100 provides the backlight unit 500 with a backlight control signal BCS. The backlight unit 500 generates light in response to the backlight control signal BCS and supplies the light to the liquid crystal display panel 400.

In exemplary embodiments, the backlight unit 500 may use light emitting diodes (not shown) as a light source. The light emitting diodes may be arranged on a printed circuit board to have a stripe shape along one direction or to have a matrix shape.

Figure 2:
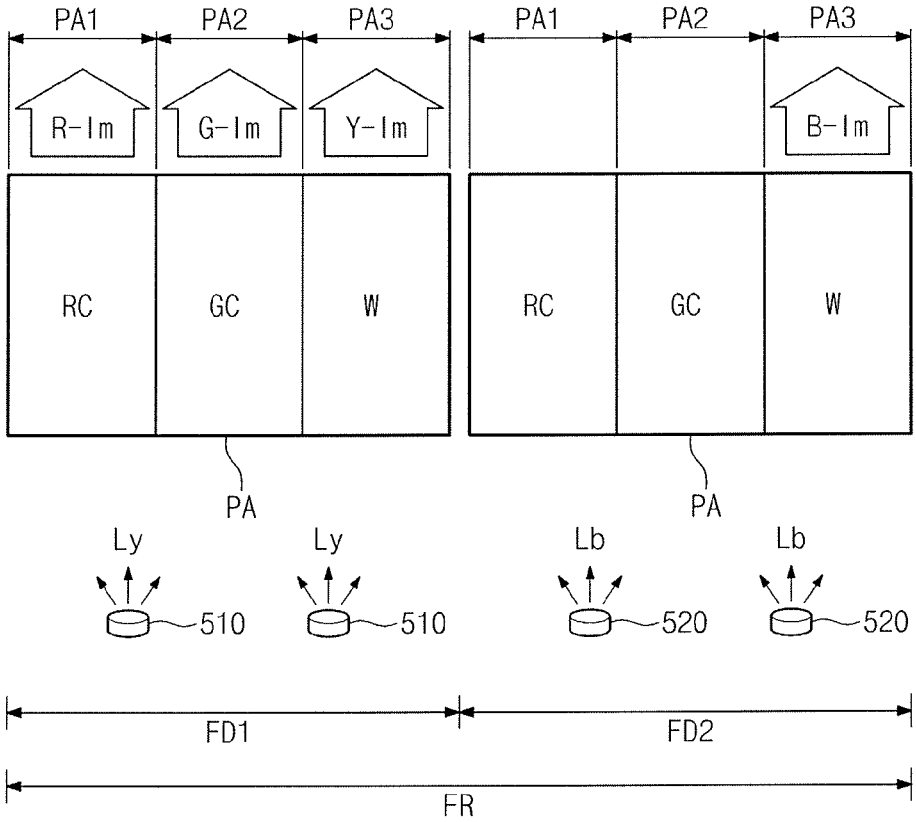
FIG. 2 is a diagram for describing a principle of expressing a full color using a time/spatial division manner.

FIG. 2 is a diagram for describing a principle of expressing a full color using a time/spatial division manner.

Referring to FIG. 2, it is assumed that areas of a liquid crystal display panel 100 (refer to FIG. 1) corresponding to first to third pixels PX1 to PX3 are referred to as first to third pixel areas PA1 to PA3. With this assumption, first and second color filters are provided in the first and second pixel areas PA1 and PA2, and an open portion W is provided in third pixel area PA3.

The first color filter may be formed of a red color filter RC that transmits a red light, and the second color filter may be formed of a green color filter GC that transmits a green light. Since the open portion W does not include a color filter, light incident to the open portion W is passed without filtering.

A backlight unit 500 (refer to FIG. 1) includes a first light source 510 to generate first color light and a second light source 520 to generate second color light.

A frame FR is divided into first and second fields FD1 and FD2 according to a temporal order. As the first light source 510 is driven during a period corresponding to the first field FD1, the first color light is output from the backlight unit 500. The first color light is provided to the liquid crystal display panel 400. Afterwards, as the second light source 520 is driven during a period corresponding to the second field FD2, the second color light is output from the backlight unit 500. The second color light is provided to the liquid crystal display panel 400. Hereinafter, the frame FR may be interchangeably referred to as a frame period; the first field FD1 may be interchangeably referred to as a first subframe time; the second field FD2 may be interchangeably referred to as a second subframe time. The frame period FD may be formed of the first and second subframe times FD1 and FD2.

In exemplary embodiments, the first color light may be formed of yellow light Ly, and the second color light may be formed of blue light Lb. If the first color light is the yellow light Ly, it may include red-light and green-light components.

During the period corresponding to the first field FD1, a red-light component of the yellow light Ly the backlight unit 500 generates passes the red color filter RC to be displayed as a red image R-Im. Also, a green-light component of the yellow light Ly passes the green color filter GC to be displayed as a green image G-Im. The yellow light Ly passes the open portion W to be displayed as a yellow image Y-Im.

During the period corresponding to the second field FD2, the blue light Lb passes the open portion W to be displayed as a blue image B-Im. However, the blue image B-Im is not displayed through the first and second pixel areas PA1 and PA2 because it does not pass the red and green color filters RC and GC.

With the above description, the yellow image Y-Im is displayed via the open portion W during the first field FD1, and the blue image B-Im is displayed via the open portion W during the second field FD2. Since the open portion W does not include a color filter, it passes the first and second color lights Ly and Lb without light loss due to a color filter. Thus, light efficiency of the liquid crystal display apparatus 1000 may be increased.

Figure 3:
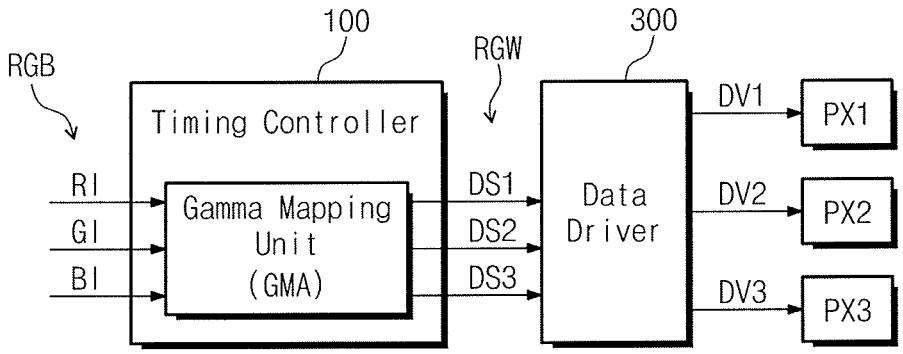
FIG. 3 is a block diagram illustrating an operation of a liquid crystal display apparatus in first and second fields, according to an exemplary embodiment of the present invention.
Figure 3:
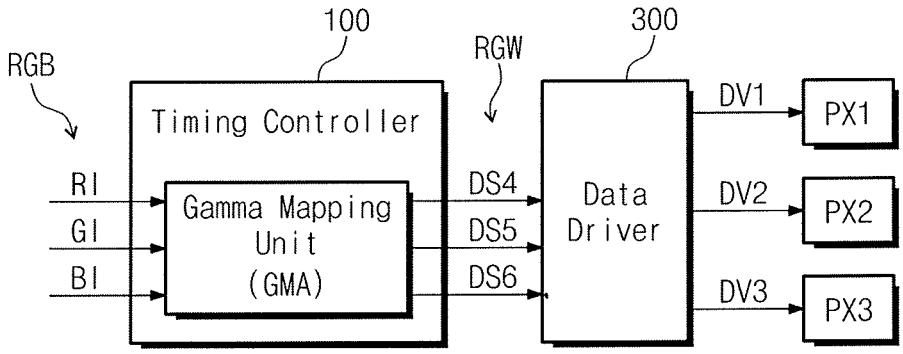

FIG. 3 is a block diagram illustrating an operation of a liquid crystal display apparatus in first and second fields, according to an exemplary embodiment of the present invention.

Referring to FIG. 3, a timing controller 100 includes a gamma mapping unit GMA.

The gamma mapping unit GMA generates image data RGW based on image information RGB. For example, the image information RGB includes red image information RI, green image information GI, and blue image information BI corresponding to a red primary-color space, a green primary-color space, and a blue primary-color space. The gamma mapping unit GMA converts the red, green, and blue image information RI, GI, and BI into the image data RGW using color-gamut mapping functions. An image corresponding to the image data RGW may be displayed through first to third pixels PX1 to PX3, using different color light during first and second fields FD1 and FD2. The first to third pixels PX1 to PX3 may serve as subpixels of a pixel to display a full color image. For example, the first pixel PX1 may display a red color image; the second pixel PX2 may display a green color image; the third pixel PX3 may display a blue image.

The red image information RI includes information about a red image R-Im (refer to FIG. 2), the green image information GI includes information about a green image G-Im (refer to FIG. 2), and the blue image information BI includes information about a blue image B-Im (refer to FIG. 2).

The image data RGW includes first to sixth data signals DS1 to DS6 for the pixels PX1 to PX3. The first to third data signals DS1 to DS3 control the first to third pixels PX1 to PX3 during the first field FD1. The fourth to sixth data signals DS4 to DS6 control the first to third pixels PX1 to PX3 during the second field FD2.

In the first field FD1, the gamma mapping unit GMA generates first to third data signals DS1 to DS3. The first to third data signals DS1 to DS3 are converted into first to third data voltages DV1 to DV3 via a data driver 300. As described above, the first to third data voltages DV1 to DV3 are provided to the first to third pixels PX1 to PX3.

In the second field FD2, the gamma mapping unit GMA generates the fourth to sixth data signals DS4 to DS6. The fourth to sixth data signals DS4 to DS6 are converted into the first to third data voltages DV1 to DV3 via the data driver 300. As described above, the first to third data voltages DV1 to DV3 correspond to the first to third pixels PX1 to PX3.

Figure 4:
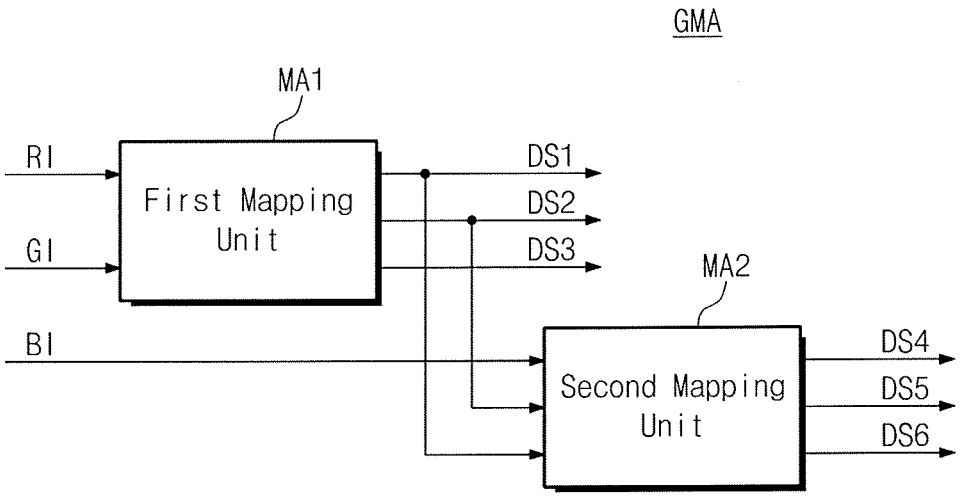
FIG. 4 is a block diagram illustrating a gamma mapping unit according to an exemplary embodiment of the present invention.
Figure 5:
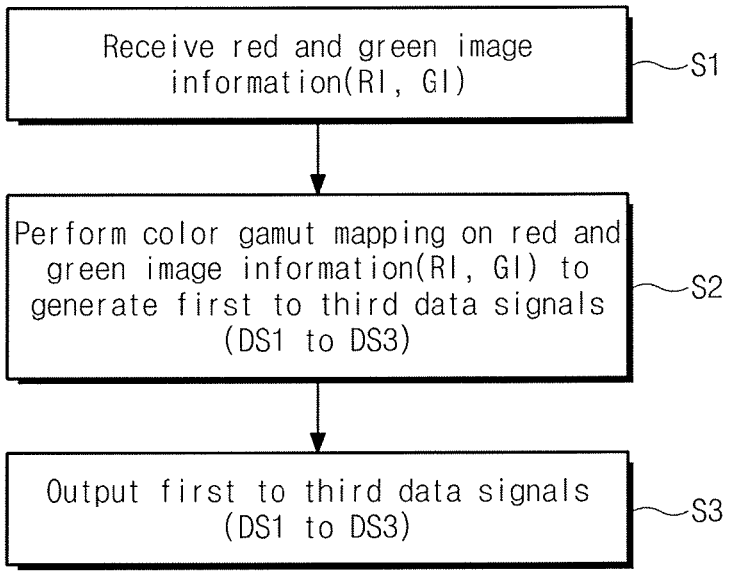
FIG. 5 is a flow chart illustrating an operating procedure of a first mapping unit shown in FIG. 4.
Figure 6:
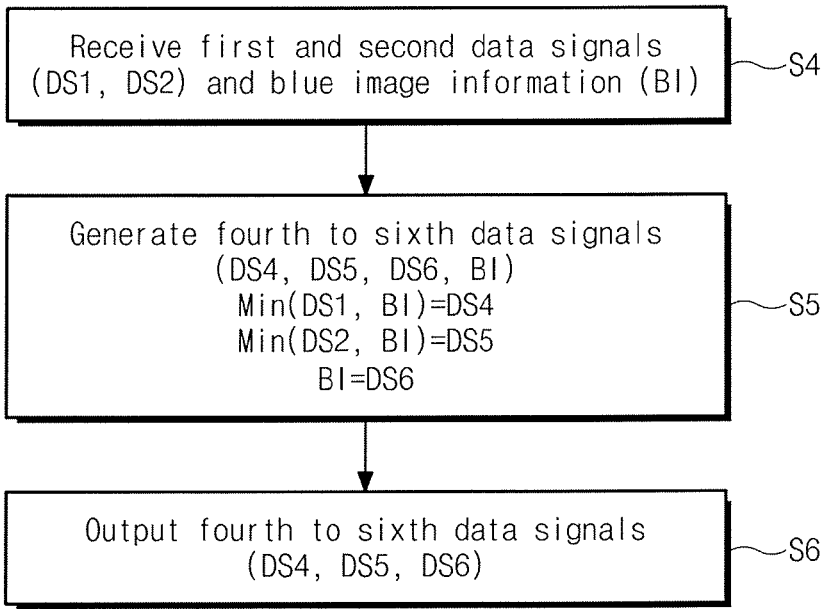
FIG. 6 is a flow chart illustrating an operating procedure of a second mapping unit shown in FIG. 4.

FIG. 4 is a block diagram illustrating a gamma mapping unit according to an exemplary embodiment of the present invention. FIG. 5 is a flow chart illustrating an operating procedure of a first mapping unit shown in FIG. 4. FIG. 6 is a flow chart illustrating an operating procedure of a second mapping unit shown in FIG. 4.

Referring to FIGS. 4 to 6, a gamma mapping unit GMA includes a first mapping unit MA1 and a second mapping unit MA2. The first mapping unit MA1 generates first to third data signals DS1 to DS3 to be supplied to a data driver 300 (refer to FIG. 3) during a first field FD1, and the second mapping unit MA2 generates fourth to sixth data signals DS4 to DS6 to be supplied to the data driver 300 during a second field FD2 (refer to FIG. 3).

The first mapping unit MA1 receives red and green image information RI and GI (S1). The first mapping unit MA1 performs color-gamut mapping based on the red and green image information RI and GI to generate first to third data signals DS1 to DS3 (S2).

For example, the first mapping unit MA1 gamma corrects the red and green image information according to the gamut characteristics of the liquid display panel 400 to generate the first and second data signals DS1 and DS2. The first mapping unit MA1 may gamma correct the red image information with a first gamma value to generate the first data signal DS1 and gamma correct the green image information with a second gamma value different from the first gamma value to generate the second data signal DS2. The first mapping unit MA1 may generate the third data signal DS3 to correspond to one of the first and second data signals DS1 and DS2, whichever is smaller in grayscale values of the first and second data signals DS1 and DS2.

The first mapping unit MA1 provides the first to third data signals DS1 to DS3 to the data driver 300 (S3).

The second mapping unit MA2 receives the first and second data signals DS1 and DS2 and the blue image information BI from the first mapping unit MA1 (S4).

The second mapping unit MA2 generates fourth and sixth data signals DS4 and DS6 based on the first and second data signals DS1 and DS2 and the blue image information BI (S5).

For example, the second mapping unit MA2 generates the fourth data signal DS4 using one of the first data signal DS1 and the blue image information BI, whichever is smaller in grayscale values of the first data signal DS1 and the blue image information BI. The second mapping unit MA2 generates the fifth data signal DS5 using one of the second data signal DS2 and the blue image information BI, whichever is smaller in grayscale values of the second data signal DS2 and the blue image information BI. Also, the gamma mapping unit GMA generates the blue image information BI as the sixth data signal DS6.

The second mapping unit MA2 outputs the fourth to sixth data signals DS4 to DS6 thus generated to the data driver 300 (S6).

According to an exemplary embodiment, the first and second data signals DS1 and DS2 of the first field FD1 are used to generate the fourth and fifth data signals DS4 and DS5, and thus a difference in grayscale values between the first and second pixels PX1 and PX2 decreases between the first field FD1 and the second field FD2. Since rearrangement of liquid crystal molecules between the first and second fields FD1 and FD2 may be unnecessary or small due to such decreased difference of grayscale values, the first and second pixels PX1 and PX2 express grayscale values within a given time without reducing brightness of the liquid crystal display apparatus 1000.

Returning to FIG. 2, it is assumed that an image displayed is expressed using 256 different grayscale values. If the liquid crystal display apparatus 1000 displays a white image over plural frames including a current frame FR, the red, green, and blue image information RI, GI, and BI and the first to sixth data signals DS1 to DS6 have a maximum grayscale value of 255 by the gamma mapping unit GMA. Thus, when the light source is changed from the yellow light for the first field FD1 to the blue light for the second field FD2, the maximum grayscale value of 255 displayed by the first and second pixels PX1 and PX2 is transferred from the first field FD1 to the second field FD2 without changing of the grayscale values. This may mean that it is unnecessary to rearrange liquid crystal molecules between the first and second field FD1 and FD2 for the first and second pixels PX1 and PX2. Accordingly, transmittance of a liquid crystal layer does not decrease due to insufficient rearrangement of liquid crystal molecules when the yellow light and the blue light are sequentially provided. Since it is possible to prevent a decrease in the transmittance of the liquid crystal layer, brightness of the liquid crystal display apparatus 1000 is increased.

As described above, the second mapping unit MA2 generates the fourth data signal DS4 from one of the first data signal DS1 and the blue image information BI, whichever is smaller in grayscale values of the first data signal DS1 and the blue image information BI. The second mapping unit MA2 also generates the fifth data signal DS5 from one of the second data signal DS2 and the blue image information BI, whichever is smaller in grayscale values of the second data signal DS2 and the blue image information BI. Accordingly, it is possible to prevent a color reproduction range of the liquid crystal display apparatus 1000 from decreasing due to blue leakage of the red and green color filters RC and GC.

For example, since the second mapping unit MA2 generates the fourth data signal DS4 using one of the first data signal DS1 and the blue image information BI, whichever is smaller in grayscale values of the first data signal DS1 and the blue image information BI, and since the second mapping unit MA2 generates the fifth data signal DS5 using one of the second data signal DS2 and the blue image information BI, whichever is smaller in grayscale values of the second data signal DS2 and the blue image information BI, it is possible to decrease a difference in gray-scale values of the first and second pixels PX1 and PX2 during the second field FD2. Thus, the amount of light provided to the red and green color filters RC and GC is reduced. As the amount of light provided to the red and green color filters RC and GC is reduced, the amount of blue leakage decreases; thus, it is possible to prevent a color reproduction range of the liquid crystal display apparatus 1000 from decreasing due to blue leakage.

According to an exemplary embodiment, the second mapping unit MA2 generates the fourth data signal DS4 using one of the first data signal DS1 and the blue image information BI, whichever is smaller in grayscale values of the first data signal DS1 and the blue image information BI. The second mapping unit MA2 also generates the fifth data signal DS5 using one of the second data signal DS2 and the blue image information BI, whichever is smaller in grayscale values of the second data signal DS2 and the blue image information BI. However, the present invention is not limited thereto.

For example, the second mapping unit MA2 may generate the fourth data signal DS4 using one of the first data signal DS1 and the blue image information BI, whichever is larger in grayscale values of the first data signal DS1 and the blue image information BI. The second mapping unit MA2 may generate the fifth data signal DS5 using one of the second data signal DS2 and the blue image information BI, whichever is larger in grayscale values of the second data signal DS2 and the blue image information BI. In this case, brightness of the liquid crystal display apparatus 1000 is increased. For example, the second mapping unit MA2 may provide a data signal having a larger grayscale value of a data signal of the first mapping unit MA1 and the blue image information BI, and thus the amount of light provided to the red and green color filters RC and GC increases; so, brightness of the liquid crystal display apparatus 1000 is increased.

Alternatively, the second mapping unit MA2 may generate the fourth data signal DS4 using an average grayscale value of the first data signal DS1 and the blue image information BI and the fifth data signal DS5 using an average grayscale value of the second data signal DS2 and the blue image information BI.

Figure 7:
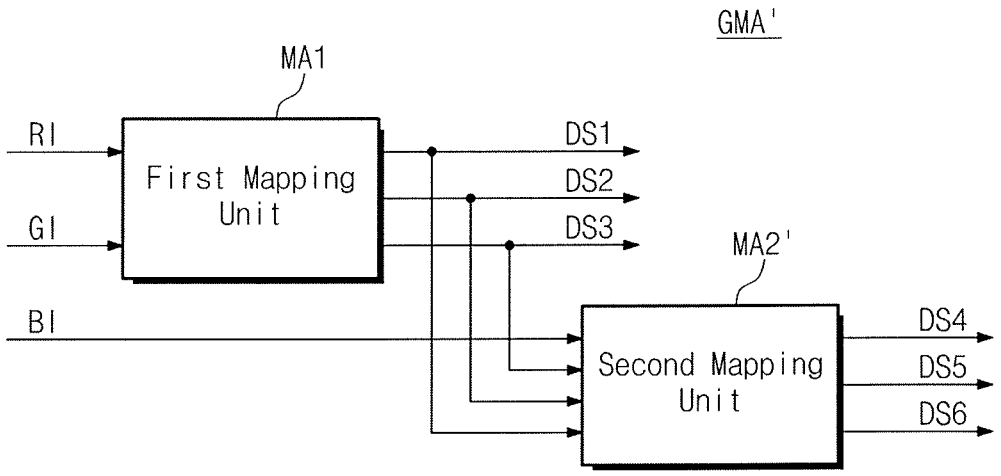
FIG. 7 is a block diagram illustrating a gamma mapping unit according to an exemplary embodiment of the present invention.
Figure 8:
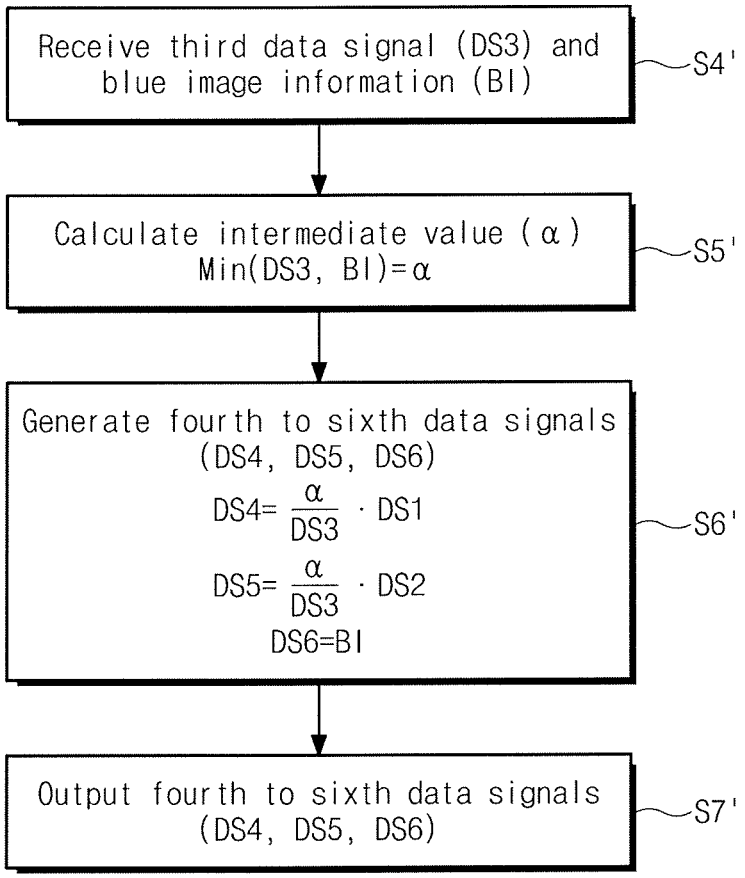
FIG. 8 is a flow chart illustrating an operating procedure of a second mapping unit shown in FIG. 7.

FIG. 7 is a block diagram illustrating a gamma mapping unit according to an exemplary embodiment of the present invention. FIG. 8 is a flow chart illustrating an operating procedure of a second mapping unit shown in FIG. 7. In FIGS. 7 and 8, components that are substantially identical to those in FIGS. 1 to 6 are marked by the same reference numerals. A gamma mapping unit GMA' shown in FIG. 7 is substantially the same as a gamma mapping unit GMA shown in FIG. 4 except for a second mapping unit MA2, and the description thereof is thus omitted.

Referring to FIGS. 7 and 8, the gamma mapping unit GMA' includes a first mapping unit MA1 and a second mapping unit MA2'. The second mapping unit MA2' generates fourth to sixth data signals DS4 to DS6. When a current field is a second field FD2, the second mapping unit MA2' generates the fourth and fifth data signals DS4 and DS5 based on the third data signal DS3 and blue image information BI.

The second mapping unit MA2' receives the third data signal DS3 and the blue image information BI (S4').

One of the third data signal DS3 and the blue image information BI, whichever is smaller in grayscale values of the third data signal DS and the blue image information BI, is generated as an intermediate value (α).

The second mapping unit MA2' generates the fourth and fifth data signals DS4 and DS5 using the intermediate value (α). For example, the second mapping unit MA2' generates the fourth and fifth data signals DS4 and DS5 using the following equations (1) and (2) and outputs the blue image information BI as the sixth data signal DS6 (S6').

$$DS4 = \frac{\alpha}{DS3} DS1 \tag{1}$$

In the equation (1), "DS4" is a grayscale value of a fourth data signal, "DS1" is a grayscale value of a first data signal", "DS3" is a grayscale value of a third data signal, and "a" is an intermediate value.

$$DS5 = \frac{\alpha}{DS3} DS2 \tag{2}$$

In the equation (2), "DS5" is a grayscale value of a fifth data signal, "DS2" is a grayscale value of a second data signal", "DS3" is a grayscale value of a third data signal, and "a" is an intermediate value.

The second mapping unit MA2' outputs the fourth to sixth data signals DS4 to DS6 during a second field FD2 (S7').

If the fourth and fifth data signals DS4 and DS5 are generated using the third data signal DS3 and the blue image information BI, a difference in grayscale values between the first and second pixels PX1 and PX2 decreases between the first field FD1 and the second field FD2. Since rearrangement of liquid crystal molecules between the first and second fields FD1 and FD2 is unnecessary or small, the first and second pixels PX1 and PX2 express grayscale values within a given time without reducing brightness of the liquid crystal display apparatus 1000.

Returning to FIG. 2, it is assumed that an image displayed is expressed using 256 different grayscale values. If the liquid crystal display apparatus 1000 displays a white image over plural frames including a current frame FR, the red, green, and blue image information RI, GI, and BI and the first to sixth data signals DS1 to DS6 have a maximum grayscale value of 255 by the gamma mapping unit GMA. Thus, the light source is changed from the yellow light for the first field FD1 to the blue light for the second field FD2, and the maximum grayscale value of 255 displayed by the first and second pixels PX1 and PX2 is transferred from the first field FD1 to the second field FD2 without changing of the grayscale value. This may mean that it is unnecessary to rearrange liquid crystal molecules corresponding to the first and second pixels PX1 and PX2. Accordingly, transmittance of a liquid crystal layer does not decrease due to insufficient rearrangement of liquid crystal molecules when the yellow light and the blue light is sequentially provided. Since it is possible to prevent a decrease in the transmittance of the liquid crystal layer, brightness of the liquid crystal display apparatus 1000 is increased.

The second mapping unit MA2' generates the fourth and fifth data signals DS4 and DS5 from one of the third data signal DS3 and the blue image information BI, whichever is smaller in grayscale values of the third data signal DS3 and the blue image information BI. Accordingly, it is possible to prevent a color reproduction range of the liquid crystal display apparatus 1000 from decreasing due to blue leakage of the red and green color filters RC and GC.

For example, since the second mapping unit MA2' generates the fourth and fifth data signals DS4 and DS5 using one of the third data signal DS3 and the blue image information BI, whichever is smaller in grayscale values of the third data signal DS3 and the blue image information BI, it is possible to reduce gray-scale values of the first and second pixels PX1 and PX2 during the second field FD2. Thus, the amount of light provided to the red and green color filters RC and GC is reduced. As the amount of light provided to the red and green color filters RC and GC is reduced, the amount of blue leakage decreases; thus, it is possible to prevent a color reproduction range of the liquid crystal display apparatus 1000 from decreasing due to blue leakage.

Figure 9:
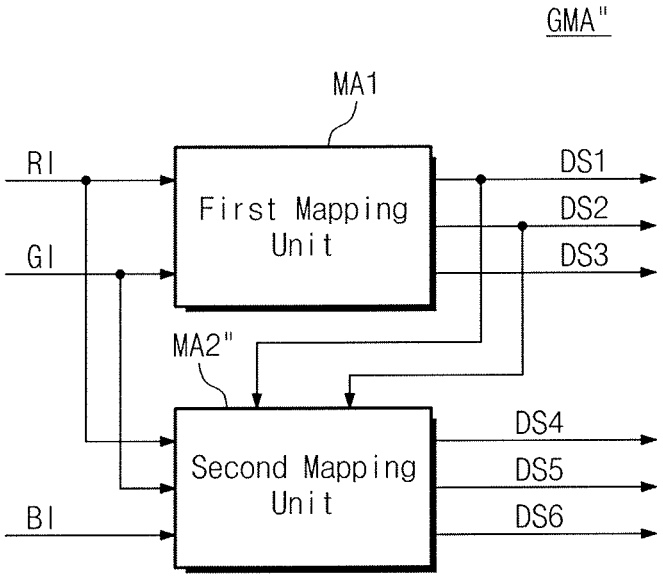
FIG. 9 is a block diagram illustrating a gamma mapping unit according to an exemplary embodiment of the present invention.
Figure 10:
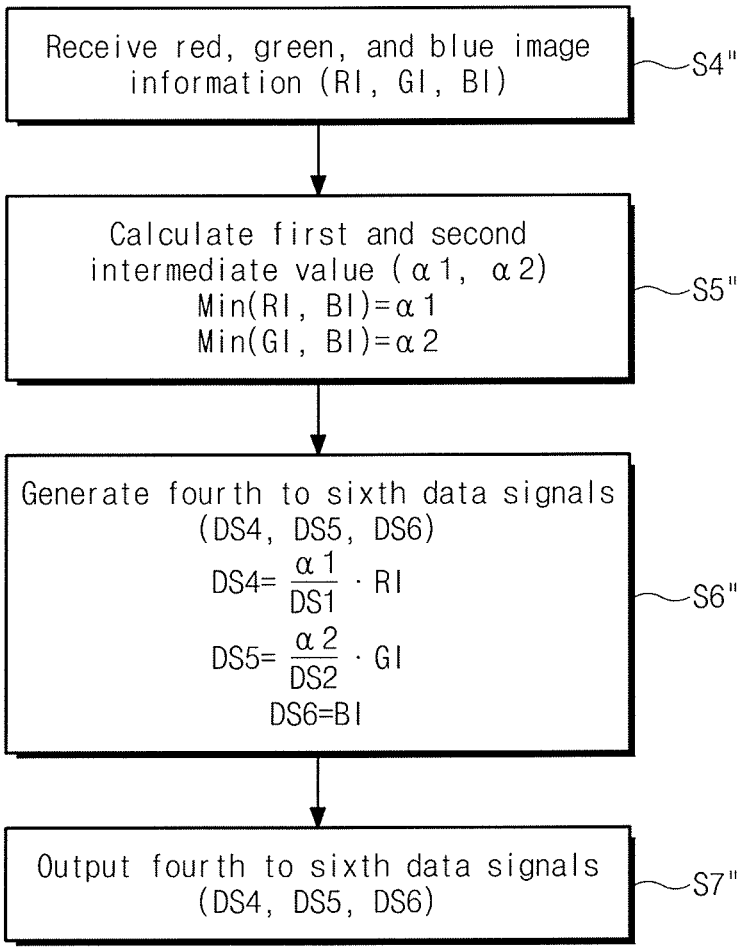
FIG. 10 is a flow chart illustrating an operating procedure of a second mapping unit shown in FIG. 9.

FIG. 9 is a block diagram illustrating a gamma mapping unit according to an exemplary embodiment of the present invention. FIG. 10 is a flow chart illustrating an operating procedure of a second mapping unit shown in FIG. 9. In FIGS. 9 and 10, components that are substantially identical to those in FIGS. 1 to 6 are marked by the same reference numerals. A gamma mapping unit GMA" shown in FIG. 9 is substantially the same as a gamma mapping unit GMA shown in FIG. 4 except for a second mapping unit MA2", and the description thereof is thus omitted.

Referring to FIGS. 9 and 10, the gamma mapping unit GMA" includes a first mapping unit MA1 and a second mapping unit MA2". The second mapping unit MA2" generates fourth to sixth data signals DS4 to DS6.

When a current field is a second field FD2, the second mapping unit MA2" generates the fourth and fifth data signals DS4 and DS5 based on red, green, and blue image information RI, GI, and BI.

The second mapping unit MA2" receives the red, green, and blue image information RI, GI, and BI (S4").

The second mapping unit MA2" generates one of the red image information RI and the blue image information BI, whichever is smaller in grayscale values of the red and blue image information RI and BI, as a first intermediate value (al). The second mapping unit MA2" generates one of the green image information GI and the blue image information BI, whichever is smaller in grayscale values of the green and blue image information GI and BI, as a second intermediate value ($\alpha 2$) (S5").

The second mapping unit MA2' generates the fourth and fifth data signals DS4 and DS5 using the first and second intermediate values ($\alpha 1$, $\alpha 2$). For example, the second mapping unit MA2" generates the fourth and fifth data signals DS4 and DS5 using the following equations (3) and (4) and outputs the blue image information BI as the sixth data signal DS6 (S6").

$$DS4 = \frac{\alpha 1}{DS1} RI \tag{3}$$

In the equation (3), "DS4" is a grayscale value of a fourth data signal, "DS3" is a grayscale value of a third data signal", "RI" is red image information, and "$\alpha 1$" is a first intermediate value.

$$DS5 = \frac{\alpha 2}{DS2} GI \tag{4}$$

In the equation (4), "DS5" is a grayscale value of a fifth data signal, "DS3" is a grayscale value of a third data signal", "GI" is a grayscale value of green image information, and "$\alpha 2$" is a second intermediate value.

The second mapping unit MA2" outputs the fourth to sixth data signals DS4 to DS6 during a second field FD2 (S7").

If the fourth and fifth data signals DS4 and DS5 are generated using the red, green, and blue image information RI, GI, and BI, a difference in grayscale values between the first and second pixels PX1 and PX2 decreases between the first field FD1 and the second field FD2. Since rearrangement of liquid crystal molecules between the first and second fields FD1 and FD2 is unnecessary or small, the first and second pixels PX1 and PX2 express grayscale values within a given time without reducing brightness of the liquid crystal display apparatus 1000.

Returning to FIG. 2, it is assumed that an image displayed is expressed using 256 different grayscale values. If the liquid crystal display apparatus 1000 displays a white image over plural frames including a current frame FR, the red, green, and blue image information RI, GI, and BI and the first to sixth data signals DS1 to DS6 have a maximum value of 255 by the gamma mapping unit GMA. Thus, when the light source is changed from the yellow light for the first field FD1 to the blue light for the second field FD2, the maximum grayscale value of 255 displayed by the first and second pixels PX1 and PX2 is transferred from the first field FD1 to the second field FD2 without changing of the grayscale value. This may mean that it is unnecessary to rearrange liquid crystal molecules corresponding to the first and second pixels PX1 and PX2. Accordingly, transmittance of a liquid crystal layer does not decrease due to insufficient rearrangement of liquid crystal molecules when the yellow light and the blue light are sequentially provided. Since it is possible to prevent a decrease in the transmittance of the liquid crystal layer, brightness of the liquid crystal display apparatus 1000 is increased.

The second mapping unit MA2" generates the fourth data signal DS4 using one of the red and blue image information RI and BI, whichever is smaller in grayscale values of the red and blue image information RI and BI, and the fifth data signal DS5 using one of the green and blue image information GI and BI, whichever is smaller in grayscale values of the green and blue image information GI and BI. Accordingly, it is possible to prevent a color reproduction range of the liquid crystal display apparatus 1000 from decreasing due to blue leakage of the red and green color filters RC and GC.

For example, since the second mapping unit MA2" generates the fourth and fifth data signals DS4 and DS5 using one of the red, green, and blue image information RI, GI, and BI, whichever is smaller in grayscale values of the red, green and blue image information RI, GI and BI, it is possible to reduce the decrease in grayscale values of the first and second pixels PX1 and PX2 during the second field FD2. Thus, the amount of light provided to the red and green color filters RC and GC is reduced. As the amount of light provided to the red and green color filters RC and GC is reduced, the amount of blue leakage decreases; thus, it is possible to prevent a color reproduction range of the liquid crystal display apparatus 1000 from decreasing due to blue leakage.

While the present inventive concept has been shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A liquid crystal display apparatus comprising:

a backlight unit configured to sequentially provide first color light during a first subframe time of a frame and second color light during a second subframe time of the frame, wherein the first color light includes at least two primary colors;

a liquid crystal display panel configured to display an image for the frame and including a pixel, and first and second color filters, wherein the pixel is formed of first, second and third subpixels, wherein one of the at least two primary colors in the first color light transmitted through the first subpixel is output the first color filter, wherein another of the at least two primary colors in the first color light transmitted through the second subpixel is output from the second color filter, and wherein the second color light is transmitted to the third subpixel without using any color filter; and a gamma mapping unit configured to:

receive red, green and blue image information from an external device; and generate, based on the red and green image information, first to third data signals to be received at the first to third subpixels during the first subframe time respectively, and generate, based on at least blue image information and the third data signal, fourth and fifth data signals using an intermediate value to be received at the first and second subpixels during the second subframe time respectively, wherein one of the third data signal and the blue image information, whichever is smaller in grayscale values of the third data signal and the blue image information, is generated as the intermediate value, and wherein the fourth data signal is generated by:

$$\frac{\alpha}{DS3}DS1$$

and the fifth data signal is generated by:

$$\frac{\alpha}{DS3}DS2$$

where "α" is the intermediate value, and "DS1", "DS2", and "DS3" are grayscale values of the first, second, and third data signals.

2. The liquid crystal display apparatus of claim 1, wherein the first color light is yellow light and the second color light is blue light.

3. The liquid crystal display apparatus of claim 2, wherein the at least two primary colors of the first color light include a red primary color and a green primary color.

4. A liquid crystal display apparatus comprising:

a backlight unit configured to sequentially provide first color light during a first subframe time of a frame and second color light during a second subframe time of the frame, wherein the first color light includes at least two primary colors;

a liquid crystal display panel including a pixel, and first and second color filters, wherein the pixel is formed of first, second and third subpixels, wherein one of the at least two primary colors in the first color light is transmitted to the first subpixel having the first color filter, wherein another of the at least two primary colors is transmitted to the second subpixel having the second color filter, and wherein the second color light is transmitted to the third subpixel without using any color filter; and a gamma mapping unit configured to:

receive red, green and blue image information from an external device; and generate, based on the red, green and blue image information, first to third data signals for driving the first to third subpixels during the first subframe time, and generate, based on at least blue image information, fourth and fifth data signals for driving the first to second subpixels during the second subframe time, wherein one of the red and blue image information, whichever is smaller in grayscale values of the red and blue image information, is generated as a first intermediate value, wherein one of the green and blue image information, whichever is smaller in grayscale values of the green and blue image information, is generated as a second intermediate value, and wherein the gamma mapping unit is further configured to generate the fourth and fifth data signals using the first and second intermediate values, wherein the fourth data signal is generated by:

$$\frac{\alpha 1}{DS1}RI$$

and the fifth data signal is generated by:

$$\frac{\alpha 2}{DS2}GI$$

where "α1" is the first intermediate value, "α2" is the second intermediate value, "RI" is a grayscale value of the red image information, "GI" is a grayscale value of the green image information, "DS1" is a grayscale value of the first data signal and "DS2" is a grayscale value of the second data signal.

* * * * *